United States Patent [19]

Voges

[11] Patent Number: 4,751,838

[45] Date of Patent: Jun. 21, 1988

[54] MACHINE AND PROCESS FOR LEVELING SHEET METAL STRIP

[75] Inventor: Kenneth Voges, Red Bud, Ill.

[73] Assignee: Red Bud Industries, Inc., Red Bud, Ill.

[21] Appl. No.: 798,815

[22] Filed: Nov. 18, 1985

[51] Int. Cl.[4] ..... B21D 25/00

[52] U.S. Cl. ..... 72/302

[58] Field of Search ..... 72/293, 295, 302, 305, 72/311

[56] References Cited

U.S. PATENT DOCUMENTS

| | | | |
|---|---|---|---|
| 2,487,972 | 11/1949 | Katz | 72/302 |
| 2,852,062 | 9/1958 | Lorant | 72/302 |
| 3,107,716 | 10/1963 | Wehmeyer | 72/302 |
| 3,172,528 | 3/1965 | Smith | 72/302 |
| 3,403,542 | 10/1968 | Bova | 72/302 |
| 3,686,921 | 8/1972 | Roper | 72/302 |
| 3,757,557 | 9/1973 | Kost | 72/302 |
| 4,141,679 | 2/1979 | Asano | 72/302 |
| 4,485,659 | 12/1984 | Kutz | 72/302 |

FOREIGN PATENT DOCUMENTS

| | | | |
|---|---|---|---|
| 200893 | 6/1955 | Australia | 72/302 |
| 168501 | 7/1934 | Switzerland | 72/302 |
| 539832 | 9/1941 | United Kingdom | 72/302 |

*Primary Examiner*—Daniel C. Crane

*Attorney, Agent, or Firm*—Gravely, Lieder & Woodruff

[57] ABSTRACT

A machine for leveling sheet metal strip without severing or marring the strip includes two stretcher frames, each having a set of jaws which clamp down on the strip, so that a segment of the strip is isolated between the jaws of the two frames. While the jaws grip the strip with enough compressive force to prevent the strip from slipping in the jaws, and yet not mark it, the frames are forced apart with enough force to stretch the isolated segment beyond its elastic limit for the entire width of the isolated segment, thus leveling the segment. Thereupon the parting force is released, and after the isolated segment has recovered its elastic deformation, the jaws release the strip, and the strip is advanced a distance not exceeding the length of the previously isolated segment. The procedure is then repeated until the entire strip has been leveled. The machine may be utilized in combination with a feeding machine which grips the leveled portion of the strip and advances it a preset distance.

27 Claims, 3 Drawing Sheets

MACHINE AND PROCESS FOR LEVELING SHEET METAL STRIP

BACKGROUND OF THE INVENTION

This invention relates in general to leveling or flattening sheet metal and more particularly to a machine and process for leveling sheet metal that is supplied in a continuous strip, with such leveling occurring by stretching the strip over its entire width and without severing it into segments.

Many manufactured goods, such as automobiles, appliances, and office furniture, to name a few, contain substantial quantities of sheet steel which is purchased directly from steel mills, or perhaps from intermediate processors that unwind coils of mill steel, slit it and then rewind it into coils of lesser width. Upon being coiled, the sheet steel takes on a set or curvature which should be removed to convert the sheet steel into useful products, since practically all stamping and blanking operations require flat sheet as the starting material. So-called straighteners are available for this purpose. The typical straightener has a series of rolls into which the steel strip containing the coil set is fed. The rolls impart an undulated configuration to the sheet steel as it passes between them, but upon emerging from the rolls the steel is substantially flat.

Steel sheet, however, acquires additional distortions at the mill as well as during slitting. For example, often one or both edges of the sheet are longer than the center, producing an undulated edge often referred to as edge wave. On the other hand, the center may be longer than the edges, and this creates a bulge in the sheet a condition sometimes called the oil can effect. Machines do exist for eliminating the edge wave and the oil can effect.

One such machine resembles the simple straightener in that it possesses a series of rolls between which the sheet passes in a somewhat undulated manner. However along each roll are back-up bearings which are capable of deflecting the roll against which they bear. Thus, if the steel sheet passing between the rolls contains the edge effect, the rolls are deflected at their centers to stretch the center of the sheet while leaving the edges at their original length. The stretching causes the steel sheet along its center to exceed the elastic limit of the steel, so that the steel yields in this region with the amount of yield being enough to equalize the sheet dimensionally between its center and edges. Similarly, if the sheet possesses an oil can effect, the rolls are deflected more at their edges. The end result is a reasonably flat sheet of steel. This type of leveling machine, while being moderate in cost, is extremely difficult to operate and indeed calls for the exercise of a considerable amount of judgment. In short, the machine requires a highly skilled operator.

Another type of machine known as a stretcher-leveler is somewhat simpler than the flexible roll machine and less complex to operate, in that it involves simply stretching the sheet beyond its elastic limit across the entire width of the sheet. However, the segment which is to be stretched must first be severed from the distorted strip and then gripped at its ends in the jaws of C-clamps. The C-clamps are then spread apart to stretch the severed segment. The clamps of course must grip the segment tightly, and this leaves marks along the end edges of the sheet. These marks will show through painted finishes and as a consequence the edges of such stretched segments are often trimmed. Moreover, the stretching changes the length of the severed segment, making trimming all the more necessary. Thus, stretching steel or other metal sheet in the typical stretcher-leveler is a time consuming and labor intensive process Continuous tension leveling machines, which are also currently available, stretch the sheet metal strip across the entire width of the strip without having to sever the strip into segments, and these machines have gained acceptance at mills and other processors which sell coiled steel. In these machines the strip after paying off of the coil passes between two sets of rolls with the rolls of each set being arranged as capstans so as to actually grip and drive the continuous strip. Moreover, the rolls of the downstream set rotate at a slightly greater velocity than the rolls of the upstream set, so that the steel is stretched in the region between the two sets of rolls - indeed stretched beyond its elastic limit. By reason of the stretching the strip emerges from the second set of rolls in a leveled condition. These machines are extremely costly. Also, since they operate continuously, they cannot be utilized in conjunction with intermittently operated devices such as shears for severing continuous strip into useful lengths of steel sheet.

A need exists for a leveler which operates on a continuous strip of sheet steel, aluminum or other metal without severing the strip into segments and which is further available at a moderate cost.

SUMMARY OF THE INVENTION

One of the principal objects of the present invention is to provide a machine for leveling sheet metal by stretching the metal across its entire width. Another object is to provide a machine of the type stated which stretches the metal of a continuous strip without severing the strip into segments. A further object is to provide a machine of the type stated which does not require a great deal of expertise to operate. An additional object is to provide a machine which operates on an intermittent basis and as such may be used with other intermittently-operated machines such as the Sheet Transferring Device disclosed in U.S. Pat. No. 3,753,522. An additional object is to provide a machine of the type stated which tightly grips the continuous strip to isolate a segment for stretching, all without marring either surface of the strip. Still another object is to provide a machine of that stated which is not overly complex and is economical to purchase and operate. Yet another object is to provide a machine of the type stated which embodies an improved process for leveling sheet metal. These and other objects and advantages will become apparent hereinafter.

DESCRIPTION OF THE DRAWINGS

In the accompanying drawings which form part of the specification and wherein like numerals and letters refer to like parts wherever they occur

DETAILED DESCRIPTION

Figure 1:
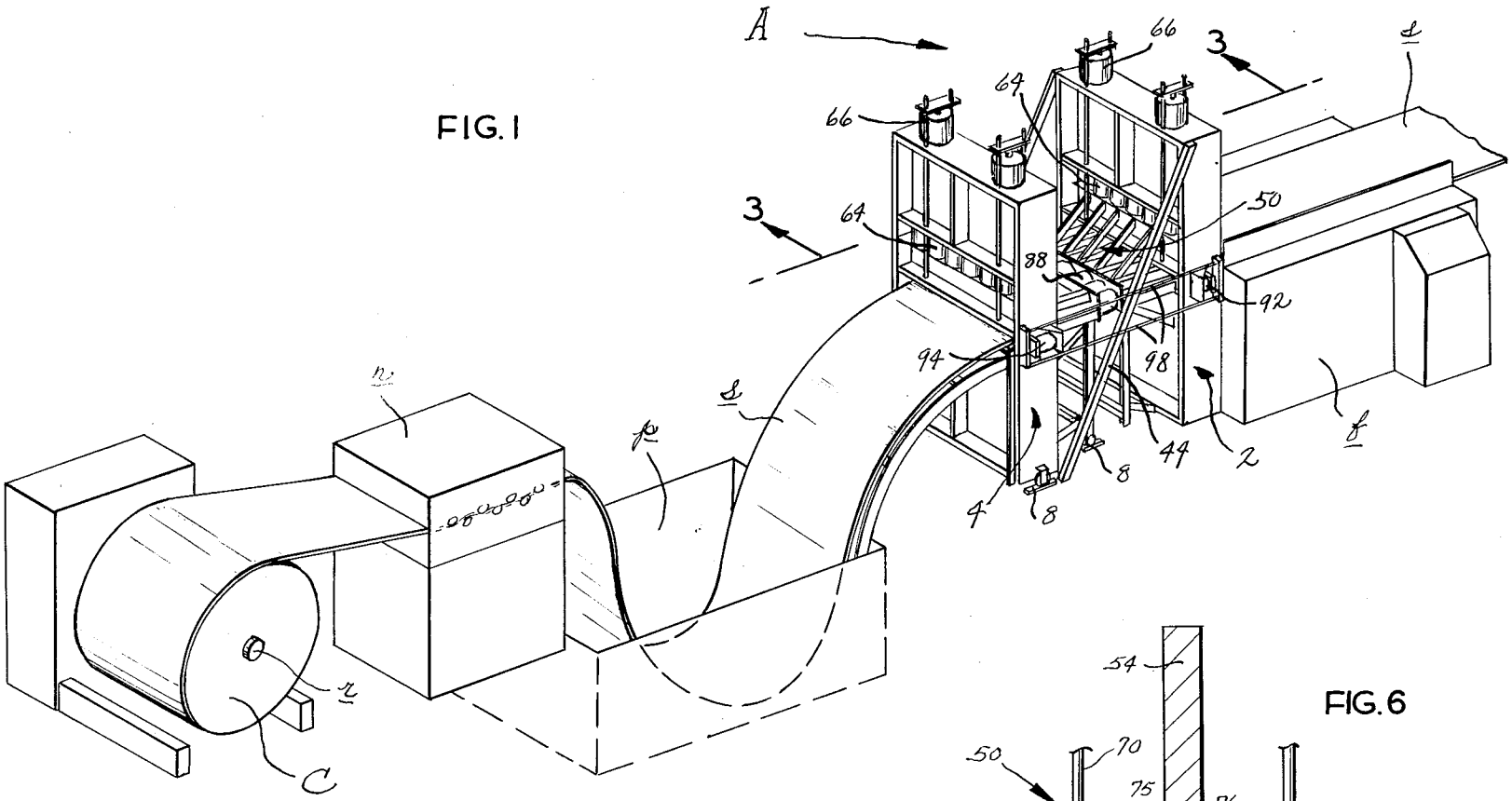
FIG. 1 is a perspective view of a stretching machine constructed in accordance with and embodying the present invention, the machine being illustrated with other machines and apparatus with which it may be used.

Referring now to the drawings, a machine A (FIG. 1) for stretching and thereby leveling a sheet metal strip s is located between a reel r on which a coil c of the strip s is supported and a feeding machine f which advances the strip s in precisely measured increments. The stretching and leveling machine A, as its name implies, stretches the metal of the strip s and in so doing flattens or levels the strip, but the stretching must exceed the elastic limit of the strip s, preferably for the entire width of the strip. In short, the metal of the strip yields. The reel r rotates and as it does the strip s of metal pays off of it into a conventional straightening machine n where the strip s passes through offset rollers that remove the coil set, that is the curvature, from it. Indeed, the straightening machine n with its powered rollers, withdraws the strip s from the coil c at a uniform velocity. Since the feeding machine f advances the strip s incrementally, a pit p exists between the straightening machine n and the stretching and leveling machine A, thus permitting the continuous strip s to accumulate somewhat while the portion of the strip s in the feeding machine f is at rest. It is during this interval of no advancement that the stretching machine A clamps down on the isolated segment of strip s that is within it and stretches that segment, forcing its one end back toward the coil c. Thus, the loop within the pit p also accommodates the slight reverse movement imparted to the strip s by the stretching and leveling machine A.

The feeding machine f normally feeds the strip s, after it has been stretched and leveled, to a shear where a precisely measured segment is severed, although it may feed other devices such as presses. A suitable feeding machine is set forth in U.S. Pat. 3,753,522 of K. Voges dated Aug. 21, 1973. The reel r is conventional as is the straightening machine n.

Thus, to summarize the operation of the entire combination, the straightening machine n withdraws the strip s from the coil c, which is on the reel r, and further removes the coil set from the strip s. Upon emerging from the straightening machine n, the strip s loops downwardly into the pit p, and then into the stretching and leveling machine A. The feeding machine f advances the strip s incrementally through the stretching and leveling machine A, with each advance being a precisely measured increment. Between incremental advances the stretching and leveling machine A clamps down on a segment of the strip s that is within the machine A to thereupon stretch that segment and level it. The incremental advances do not exceed the length of the segment isolated and stretched in the leveling machine A, so ultimately the entire strip s is leveled. While the machine A is stretching, that is while the strip s is at rest in the machine A and likewise in the feeding machine f, a shear or some other device may sever the segment of sheet that is advanced beyond the feeding machine f, this segment having already been previously leveled in the stretching and leveling machine A. The straightening machine n, however, continues to operate and the strip s which pays out of it during the interval that the opposite end is at rest merely accumulates in the loop that exists in the pit p.

Figure 3:
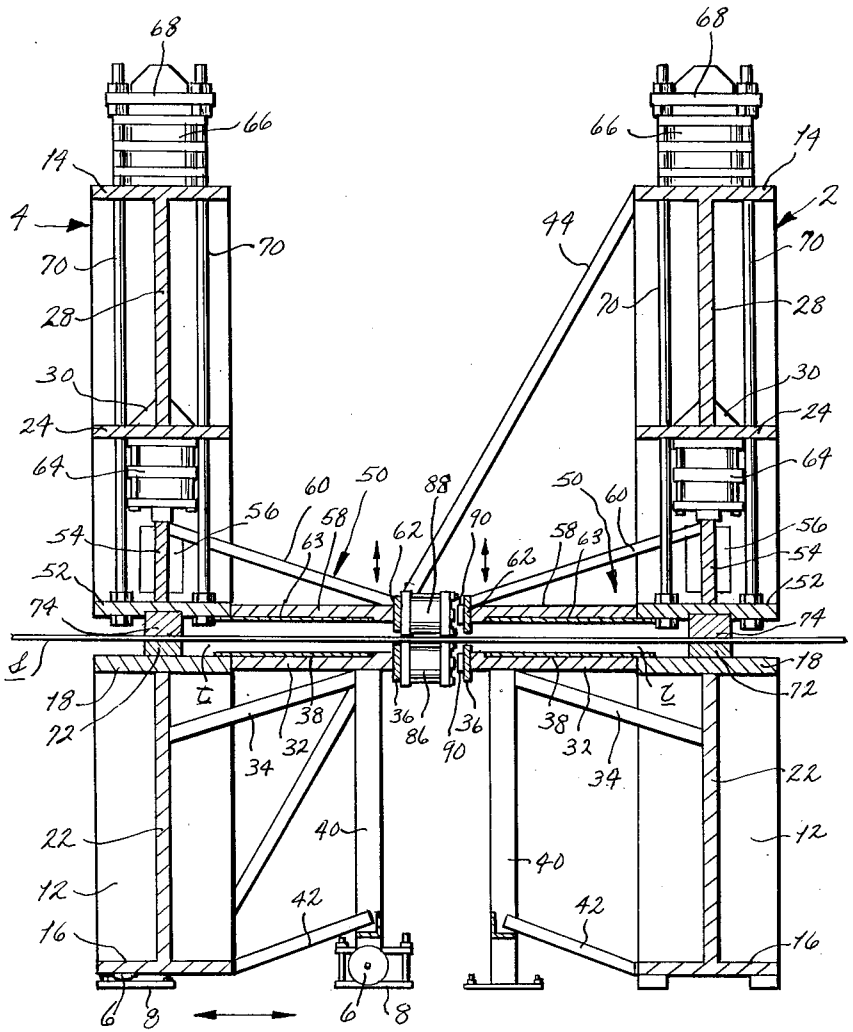
FIG. 3 is a sectional view of the stretching machine taken along line 3—3 of FIG. 1.
Figure 2:
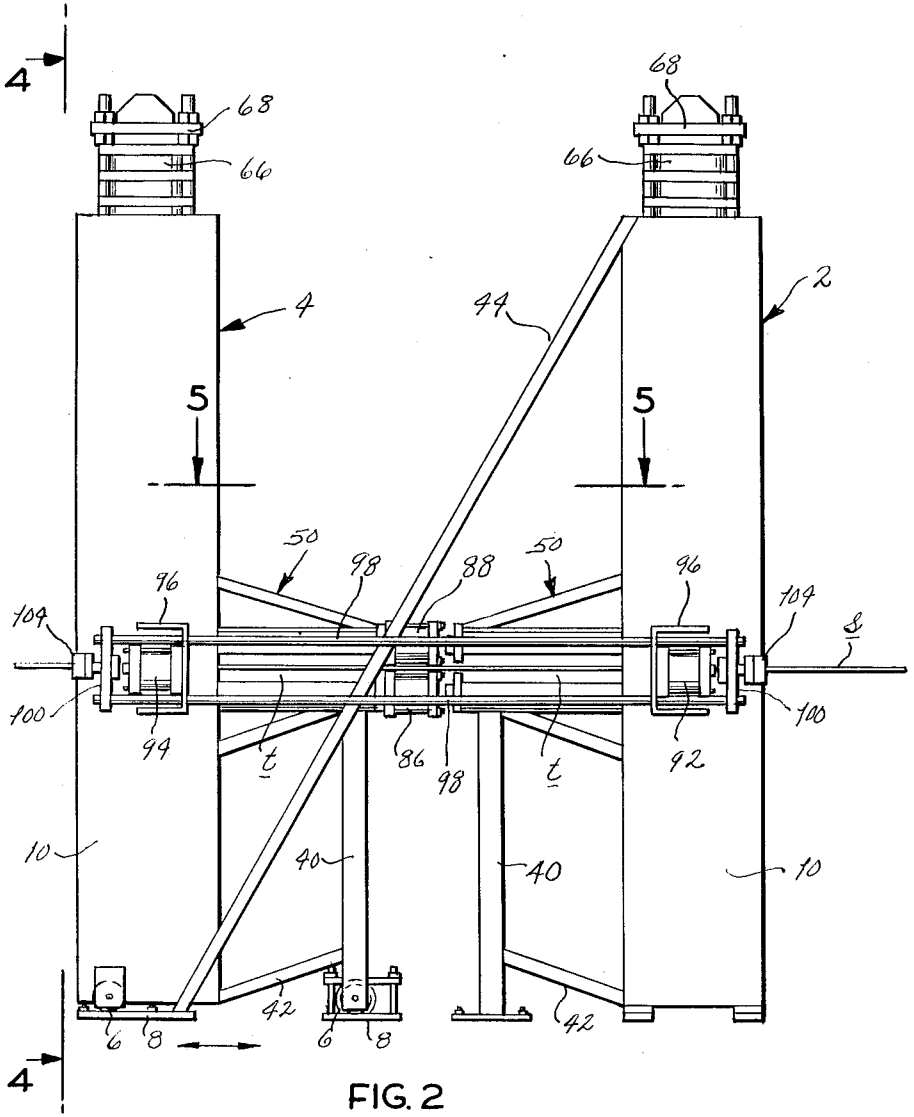
FIG. 2 is a side elevational view of the stretching machine.

Turning now to the stretching and leveling machine A, it includes two stretcher frames 2 and 4 (FIGS. 1–3). The former is anchored firmly to the floor on which it is mounted, whereas the latter frame 4 is movable, it having wheels 6 which rests upon and follow tracks 8 on the floor. The tracks 8, which are only a few inches long, extend parallel to the direction of advance for the strip s and thus enable the movable frame 4 to move toward and away from the fixed frame 2.

The two stretcher frames 2 and 4 are similar in many respects. Each includes (FIGS. 2–4) a pair of vertical side plates 10 and 12 connected at their upper ends by a top plate 14 and at their lower ends by a bottom plate 16. The strip s passes horizontally along a path t which extends through the two frames 2 and 4—indeed between the side plates 10 and 12 thereof—and underlying the path t on each frame 2 and 4 is a horizontal base plate 18 that extends between the two side plates 10 and 12. The base plate 18 is reinforced by an intermediate plate 20 which extends vertically between the bottom plate 16 and the base plate 18, and by filler plates 22 which are perpendicular to the side plates 10 and 12, the bottom plate 16 and the base plate 18 to occupy the areas bordered by them. Somewhat above the base plate 18 a backing plate 24 extends between the two side plates 10 and 12, and this plate is reinforced by another intermediate plate 26 which extends vertically between the backing plate 24 and the top plate 14, and by more filler plates 28 which occupy the areas bordered by the side, top, backing and intermediate plates 10, 12, 14, 24, and 26. Along the upper surface of the backing plate 24 and the faces of the filler plates 28 are gussets 30 which serve to further rigidify the backing plate 24. All of the plates 10–28 are welded together into a rigid fabrication, which somewhat resembles a pair of spaced apart I-beams, with the space being between the base plate 18 and the backing plate 24. This space accommodates the path t and the strip s which extends along the path t.

In addition to the plates 10–28 heretofore described, each frame 2 and 4 also has a set of horizontal brackets 32 (FIG. 3) extended from the edge of its base plate 18 toward the other frame 2 or 4, and these brackets are reinforced by oblique brackets 34 which extend between remote ends of the horizontal brackets 32 and the filler plates 22 that are below the base plate 18. Also, welded to the remote ends of the horizontal brackets 32 is a horizontal backing bar 36 which lies immediately below the path t, its length being slightly less than the width of the frames 2 and 4. Moreover, the horizontal brackets 32 support a guide plate 38 which is welded securely to those brackets 32. The guide plate 38 overlies the base plate 18 along one of its longitudinal margins and has its other longitudinal margin located close to, but offset slightly from, the backing bar 36. The guide plate 38 serves as the floor of the path t along which the strip s moves.

At the remote corners of the table top formed by the guide plate 38 are legs 40 (FIGS. 2 & 3) which at their upper ends are welded to the endmost brackets 32 and 34. The two legs 40 are connected by cross bracing (not shown) and at their lower ends are tied into the bottom plate 16 of the frame 2 or 4 by short braces 42. The legs 40 for the fixed stretcher frame 2, like the frame 2 itself, are attached securely to the floor on which the frame 2 rests. Further stability is provided to the fixed frame 2 by long braces 44 which extend diagonally from the upper ends of the two side plates 10 and 12 to the floor in the region of the tracks 8 at the side plates 10 and 12 for the movable frame 4. The legs 40 for the movable stretcher frame 4 are, on the other hand, provided with more flanged wheels 6 which ride on tracks 8 to enable the movable frame 4 to move toward and away from the fixed frame 2.

The arrangement of the brackets 32, 34, the guide plate 38 and the leg 40 on each frame 2 and 4 is such that the backing bar 36 for that frame 2 or 4 is located in a fixed and determined position with respect to the base plate 18 of that frame 2 or 4. Moreover, the backing bars 36 for the two frames 2 and 4 are located directly opposite to each other where they face each other. Finally, the brackets 32 and 34 of the two frames 2 and 4 possess enough rigidity to transmit substantial thrust loads from their respective backing bars 36 to their respective base plates 18, all without appreciable deflection of the backing bars 36.

Each of the frames 2 and 4 further carries a clamp assembly 50 (FIGS. 3 & 4) which overlies base plate 18 and the aligned guide plate 38 on the frame 2 or 4, and indeed is capable of moving toward and away from the base plate 18 and guide plate 38. Each clamp assembly 50 includes a horizontal clamp plate 52 which is located in the opening between the base and backing plates 18 and 24 for the frame 2 or 4 on which it is mounted, and as such is positioned opposite and parallel to the base plate 18. The clamp plate 52 is rigidified by a back plate 54 which is oriented vertically and welded to the clamp plate 52 midway between its margins, so that the clamp plate 52 and its back plate 54 form an integral structure of T-shaped cross-sectional configuration. Moreover, the ends of the back plate 54 fit into vertical ways 56 (FIG. 3) that are attached to the inside faces of the side plates 10 and 12 in the space between the base and backing plates 18 and 24. The ways 56 confine the back plate 54 and indeed, the entire clamping assembly 50 in the horizontal direction, but permit them to move upwardly and downwardly, toward and away from the underlying base plate 18 and guide plate 38.

In addition to the clamp and back plates 52 and 54, the clamping assembly 50 has horizontal brackets 58 (FIG. 3) and oblique brackets 60 which correspond respectively to the horizontal and oblique brackets 32 and 34 on the frame 2 or 4 and serve essentially the same purpose. More specifically, the horizontal brackets 58 for each clamping assembly 50 are attached to the clamp plate 50 and project horizontally from its edge toward the clamping assembly 50 on the other frame 2 or 4. The oblique brackets 60, on the other hand, are welded to the horizontal brackets 58 at the remote ends of those brackets and extend obliquely upwardly from those points of attachment to the vertical back plate 54 to which they are likewise attached. The horizontal brackets 58 at their remote ends support another backing bar 62 which is located directly above the lower backing bar 36 for the frame 2 or 4 which carries the clamping assembly 50. The horizontal brackets 58 also carry a guide plate 63 that is welded to them along their lower edges and laps under the clamp plate 52 for a short distance. Thus, the guide plate 63 for the clamping assembly 50 of either frame 2 or 4, lies directly over the fixed guide plate 38 for that frame 2 or 4, so the path t for accommodating the strip s along each frame 2 and 4 is for much of its length between the two guide plates 38 and 62 for the two frames 2 and 4

Figure 5:
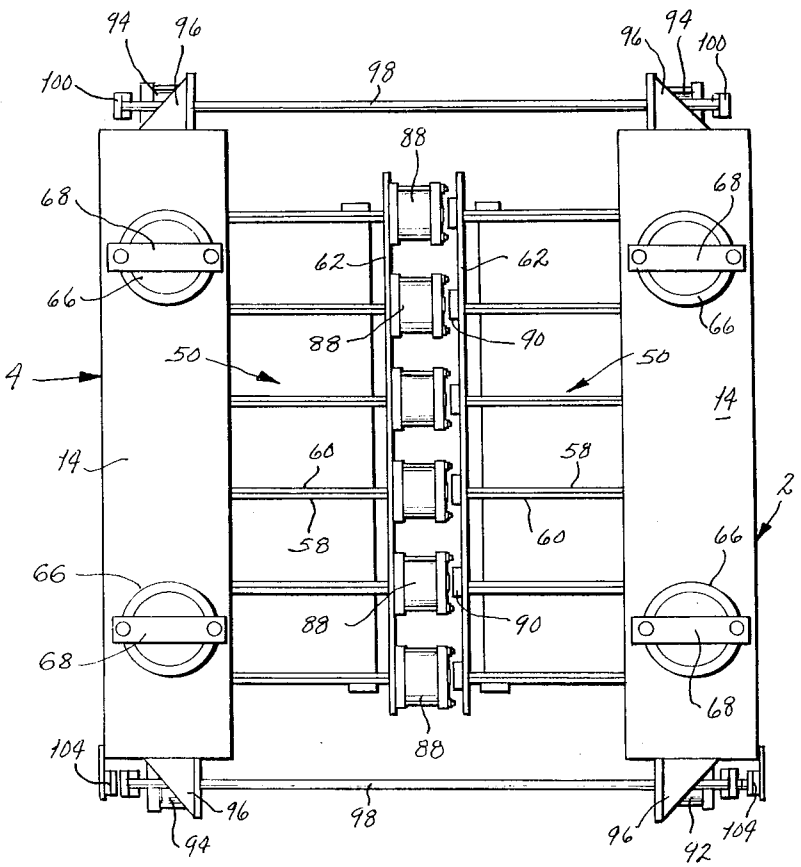
FIG. 5 is a sectional plan view of the clamping assemblies for the stretching machine taken along line 5—5 of FIG. 2.

The clamping assembly 50 for each frame 2 and 4 is arranged such that its backing bar 62 is not only located directly above the fixed backing bar 38 for its frame 2 or 4, but is also located directly opposite and indeed faces the backing bar 62 on the clamping assembly 50 for the other frame 2 or 4 (FIGS. 2, 3 & 5). Moreover, the brackets 58 and 60 for each clamping assembly 50 transmit thrust loads from the backing bar 62 to the clamp and back plates 52 and 54 without appreciable deflection of the backing bar 62, such loads being ultimately resisted by the frame 2 or 4 on which the clamping assembly 50 is mounted.

The clamping assembly 50 moves upwardly and downwardly on the frame 2 or 4 on which it is carried, and this movement is imparted by two sets of hydraulic cylinders 66 and 64 (FIGS. 3 & 4), the latter imparting the downward movement and the former the upward movement. The downward movement effects a clamping of the sheet metal strip s in the frame 2 or 4, whereas the upward movement merely serves to lift the clamping assembly 50 high enough to clear the path t and allow the strip s to slide easily along it. Thus, the cylinders 64 exert considerably more force than the cylinders 66 and are greater in number to achieve this end.

Figure 4:
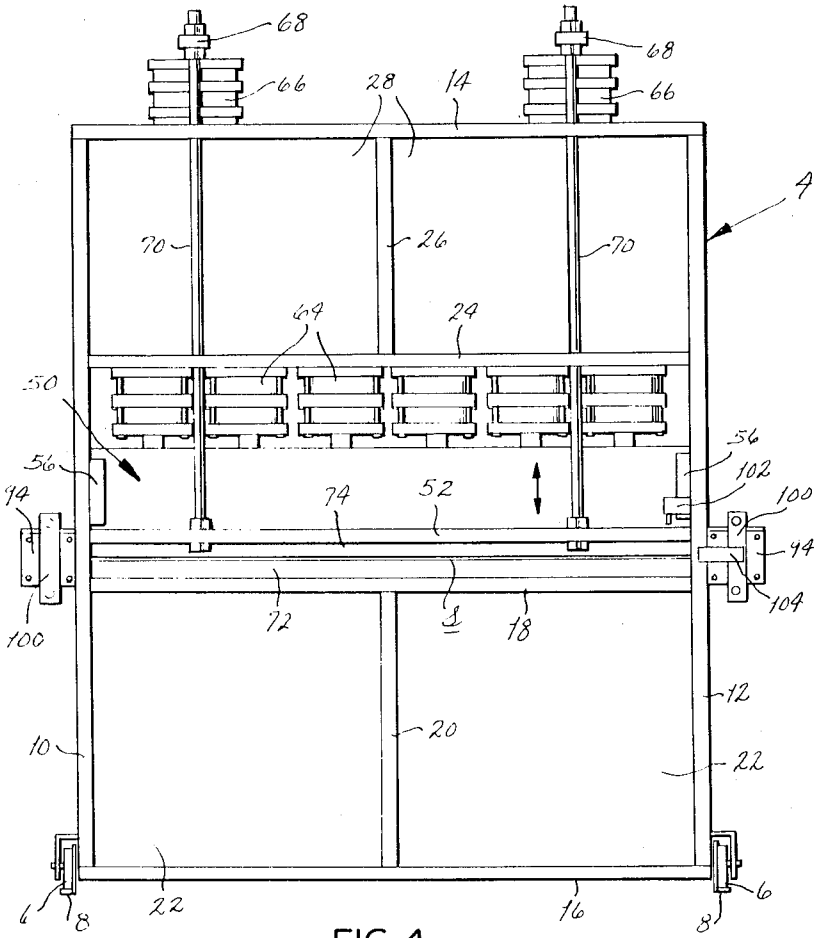
FIG. 4 is an end elevational view of the stretching machine taken along line 4—4 of FIG. 2.

The clamping cylinders 64 are located in the space between the lower surface of the backing plate 24 and the upper edge of the back plate 54 for the clamping assembly 50 (FIGS. 3 & 4). Indeed, the barrel of each clamping cylinder 64 is bolted to the backing plate 24 so as to be fixed in position with respect to the frame 2 or 4 on which it is located, while the piston rod which projects from the barrel aligns with and bears against the upper edge of the vertical back plate 54. Cylinders 64 with 6 inch bores are suitable for use in the present invention, and they are arranged as closely as possible along the backing plate 24.

The lifting cylinders 66 rest on the top plate 14 for the frame 2 or 4, their barrels being bolted to that plate such that they project upwardly therefrom (FIGS. 3 & 4). The piston rod which projects from the barrel of each cylinder 66 is fitted with a cross bar 68 which extends radially beyond the barrel where it is connected at each end to a tie rod 70. The tie rods 70 extend downwardly, passing through guide holes in the top plate 14 and the backing plate 24, and at their lower ends are attached to the clamp plate 52 of the clamping assembly 50. Thus, when the piston rods of the lifting cylinders 66 are extended, they draw the tie rods 70 upwardly, and the tie rods 70 in turn lift the clamping assembly 50. Since the clamping assembly 50 is confined by the ways 56, the movement is only in the vertical direction. The lifting cylinders 66 are multiposition so that the distance the clamping assembly is raised may be varied.

Figure 6:
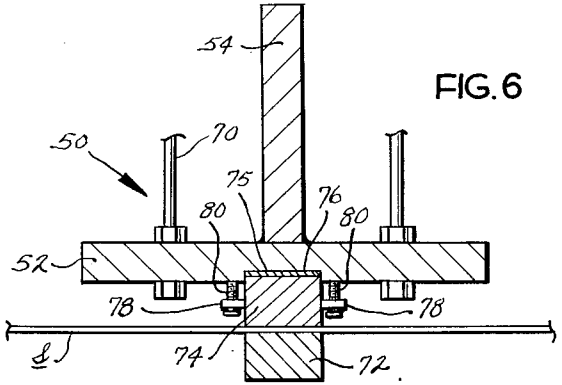
FIG. 6 is an enlarged sectional view of the clamp and backing plates as well as the jaws for gripping the sheet metal strip while it is stretched.

The base plate 18 of each frame 2 or 4 supports a clamp pad or jaw 72 (FIGS. 3, 4 & 6) which is mounted securely thereon and extends the full width of the space between the two side plates 10 and 12. The clamp plate 52 likewise carries a jaw 74 which is located directly above and aligns the fixed jaw 72 of the base plate 18 for the full width of the path t. The two jaws 72 and 74 are each about $3\frac{7}{8}$ inches wide and have smooth opposing faces for clamping against the strip s that passes through the frame 2 or 4 without marking either surface of the strip s. In contrast to the fixed lower jaw 72 which is mounted directly on the fixed base plate 18, the upper jaw 74 fits into a groove 75 (FIG. 6) that is milled into the clamp plate 52 along the lower surface thereof for the full length of that plate. In addition to accommodating the upper portion of the jaw 74, the groove 75 also contains a polyurethane pad 76 which is interposed between the base of the groove 75 and the jaw 74, it being about ¼ inches thick. The polyurethane of the pad 76 is somewhat flexible, so that even when the upper jaw 74 is seated snugly against the pad 76, the pad 76 may shift slightly relative to the clamp plate 52 to distribute a clamping force applied by the clamping cylinders 64 uniformly along the jaw 74. Along its sides the upper jaw 74 has tabs 78 which project laterally and receive bolts 80 which thread into the overlying clamp plate 52. The bolts 80 hold the upper jaw 74 on the clamp plate 52 when the clamping assembly 50 is elevated, but the tabs 78 are free to move along the shanks of the bolts 80. This occurs when the clamping cylinders 64 are energized to force the clamping assembly 50 downwardly. As it descends, the upper jaw 74 moves toward the fixed lower jaw 72 to capture the strip s between the two. The polyurethane pad 76, which is somewhat flexible, distorts under the force imparted by the cylinders 64 and thus serves to distribute the force generally uniformly across the portion of the strip s that is captured between the jaws 72 and 74. When the jaws 72 and 74 on the two stretcher frames 2 and 4 are forced together by the clamping cylinders 64, the friction between the smooth opposing surfaces of the jaws 72 and 74 and the strip s of sheet steel captured between those jaws is great enough to prevent the strip s from slipping in the jaws 72 and 74 of both frames 2 and 4 when the frames 2 and 4 are urged apart with sufficient force to stretch intervening segment of strip s beyond its elastic limit. The smooth opposing faces on the jaws 72 and 74 prevent the strip s from being marred while it is gripped in the jaws 72 and 74.

The force for urging the movable frame 4 away from the fixed frame 2 derives from a set of hydraulic spreading cylinders 86 (FIG. 3) which are located in the space between the backing bars 36 of the two frames 2 and 4 and from another set of hydraulic spreading cylinders 88 (FIGS. 3 & 5) which are located in the space between the backing bars 62 of the clamping assemblies 50 for the two frames 2 and 4. Actually, the barrels of cylinders 86 are mounted on the backing bars 36 for the movable frame 4, while the barrels for the cylinders 88 are mounted on the backing bar 62 for the clamping assembly 50 on the movable frame 4. This presents the ends of the piston rods for the cylinders 86 opposite to the backing bar 36 for the fixed frame 2 and the ends of the piston rods for the cylinders 88 opposite to the backing bar 62 on the clamping assembly 50 for the fixed frame 2. The piston rods for the cylinders 86 and 88, when extended do not, however, bear directly against the backing bars 36 and 62 to which they are directed, but instead bear against pads 90 which are mounted rigidly on those backing bars 36 and 62. For each cylinder 86 on the backing bar 36 of the movable frame 4 a corresponding cylinder 88 exists directly above it on the backing bar 62 for the clamping assembly 50 of that frame. Moreover, the array of cylinders 86 and 88 extends across substantially the entire width of the path t which is essentially the space between the side plates 10 and 12 of the two stretcher frames 2 and 4.

Thus, when the spreading cylinders 86 and 88 are energized such that their piston rods extend, the piston rods bear against the pads 90 on the backing bars 36 and 62 of the fixed frame 2, producing a reaction force that drives the movable frame 4 away from the fixed frame 2. Assuming that a segment of the sheet metal strip s is clamped between the jaws 72 and 74 for the two frames 2 and 4, it will be stressed, and if the spread is enough, the intervening segment will be stretched beyond its elastic limit across its entire width and throughout the distance between the two sets of jaws 72 and 74, so that it yields permanently in that region. Hence, when the spreading force is released and the elastic deformation is recovered, the segment is still permanently deformed, and that deformation is such that all waves and bulges are removed, leaving the segment flat. In the actual operation of the cylinders 86 and 88 the piston rods thereof are extended to their fullest extent, and the amount of spread between the frames 2 and 4 and the accompanying deformation, depends on the spacing between the jaws 72 and 74 for the frame 2 and the jaws 72 and 74 for the frame 4 when they clamp down against strip s. In most instances the full stroke of the cylinders 86 and 88 is not utilized to stretch the strip s.

The spacing between the jaws 74 and 76 of the two frames 2 and 4 when the spreading cylinders 86 and 88 are set in operation is controlled by return cylinders 92 and 94 (FIGS. 2, 5 & 7) the former being on the frame 2 and the latter on the frame 4. In particular, the barrels of the return cylinders 92 are fixed to the side plates 10 and 12 of the fixed frame 2 with their axes extending horizontally at the elevation of the path t. Similarly the barrels of the return cylinders 94 are mounted on the side plates 10 and 12 of the movable frame 4 at the same elevation and orientation. Each cylinder 92 and 94 has its back face against a gusset-type bracket 96 which ties it into the side plate 10 or 12 on which it is carried.

Extended horizontally through the brackets 96 on the side plates 10 and 12 for the two frames 2 and 4 are the upper and lower tie rods 98 (FIG. 3), and similarly a pair of tie rods 96 extend through the brackets 96 on the other side frames 12. One set of tie rods 98 is located to one side of the path t and the other set is located to the other side. While the tie rods 98 are confined radially by the brackets 96, they are nevertheless free to shift longitudinally with respect to the brackets 96. At their ends, the tie rods 96 for each set of return cylinders 92 and 94 are connected by end plates 100, which are located opposite to the ends for the piston rods on the cylinders 92 and 94.

Thus, when either the cylinders 92 or the cylinders 94 are energized their rods will extend and bear against the end plates 98 located opposite to them. The force which develops will displace the movable frame 4 toward the fixed frame 2 for the full length of the stroke for whichever cylinders 92 or 94 are energized. The stroke of the cylinders 92 may be for example ⅜ inches, while that of the cylinders 94 may be for example ¾ inches. Since the amount of the return produced by the cylinders 92 and 94 controls the distance the movable frame 4 is displaced by the spreading cylinders 86 and 88, that distance may be varied. Using the foregoing strokes as an example, when the return is derived solely from the return cylinders 92, the spread is ⅜ inches. Likewise when the return is derived solely from the return cylinders 94, the spread is ¾ inches. On the other hand, when the return is derived from both cylinders 92 and 94, the spread is the sum of the strokes for the two sets of cylinders 92 and 94 or 1⅛ inches. Even greater spreads can be obtained by placing spacer blocks between one set of cylinders 92 or 94 and the end places 98 opposite the cylinders 92. For example, a ⅜ inch block along the end plate 98 at the end of the cylinders will increase the return to 1½ inches, assuming both sets of cylinders 92 and 94 are energized.

All of the cylinders 64, 66, 86, 88, 94, and 92 are connected to manifolds which lead to a source of pressurized hydraulic fluid. Electrically operated valves are located along the manifold for directing the pressurized fluid to the various cylinders 64, 66, 86, 88, 92, and 94, and these valves are under the control of an electrical control unit. This unit may be set to accommodate strips s of various width. For example, when narrow steel strip s is in the leveling machine A, only the two centermost clamping cylinders 64 are energized to clamp the strip s between the jaws 72 and 74, for to use the outer cylinders 64 as well would deflect the upper jaw 74 and leave indentations in the strip s along its edges. With somewhat wider strips s, only the two outermost clamping cylinders 64 are rendered inactive, and with the widest strips all six clamping cylinders 64 are energized.

The control unit includes certain sensors for insuring that the cylinders 64, 66, 86, 88, 92, and 94 operate in the proper sequence. For example, a pressure sensor monitors the pressure in the clamping cylinders 64 and allows the spreading cylinders 86 and 88 to be energized only when the clamping cylinders 64 reach full pressure. This insures that the jaws 72 and 74 tightly grip the strip s before the segment isolated between the jaws 72 and 74 of the two frames 2 and 4 is stretched. More sensors, in the form of microswitches 102 (FIG. 4) monitor the positions of the clamping assemblies 50 on their respective frames 2 and 4 to insure that they are elevated before the return cylinders 92 and 94 are energized and to further insure that the feeding machine f does not move the strip s until the strip s is truly free of the jaws 72 and 74. Finally, another set of microswitch sensors 104 (FIG. 2) monitors the position of end plates 100 on the tie rods 98, that is the position of the end plates 100 with respect to the frames 2 and 4, to insure that the movable frame 4 is in the proper position relative to the fixed frame 2 before the clamping cylinders 64 are energized

OPERATION

To prepare the stretching and leveling machine A for operation either by itself or in conjunction with the feeding machine f, the metal strip s is withdrawn from the coil c at the mandrel m and brought through straightening machine n and the pit p beyond which it is allowed to loop downwardly. Then with the clamping assemblies 50 of the stretching and leveling machine A in their raised positions, the strip s is fed between the jaws 72 and 74 for the movable frame 4, thence through the space between the guide plates 38 and 63 on the movable frame 4 and into the space between the guide plates 38 and 63 on the fixed frame 2, and finally between the jaws 72 and 74 of the fixed frame 2. In other words, the strip s is merely advanced along the path t through the machine A. In addition, the appropriate return cylinders 92 and 94 are energized to bring the movable frame 4 back toward the fixed frame 2 and into a position suitable for obtaining the desired stretch. In this regard, it will be recalled that the amount of stretch imparted to the segment of the strip s on which the machine operates is controlled by the return cylinders 92 and 94 which position the movable frame 4 relative to the fixed frame 2 prior to stretching.

With the movable frame 4 properly positioned relative to the fixed frame 2, the appropriate number of clamping cylinders 64 are energized on each frame 2 and 4. These cylinders move the clamping assemblies 50 for their respective frames 2 and 4 downwardly, causing the opposed jaws 72 and 74 to approach each other and indeed clamp down against the strip s at each frame 2 and 4. The number of clamping cylinders 64 energized depends on the width of the strip s, since it is not desirable to apply the clamping force much beyond the edges of the strip s. At each frame 2 and 4, the clamping force produced by the cylinders 64 that are energized is distributed uniformly across the strip s by reason of the thin pad 76 of polyurethane interposed between the upper jaw 74 and the movable clamp plate 52 which carries that jaw. The clamping cylinders 64 effect a tight grip across the strip s at each set of clamping jaws 72 and 74, yet the jaws 72 and 74 do not mar or otherwise blemish the surfaces of the strip s.

With the strip s tightly gripped, the spreading cylinders 86 and 88 are energized, so that their piston rods extend and bear against the pads 90 on the backing bars 36 and 62 for the fixed stretcher frame 2. As a consequence, the movable frame 4 shifts rearwardly on its tracks 8 against the resistance of the segment of strip s which is between the two sets of jaws 72 and 74. The rods of the spreading cylinders 86 and 88 move to their fullest extensions, and as they do the segment of strip s between the sets of jaws 72 and 74 is stretched, first within its elastic limit, and then beyond the elastic limit so that the metal of the segment yields permanently. Enough stretch must be exerted to pass beyond the elastic limit across the entire width of the strip s. Moreover, the distortion beyond the elastic limit takes place throughout the entire length of the strip s between the jaws 72 and 74.

Thereafter, the supply of hydraulic fluid to the spreading cylinders 86 and 88 is interrupted and the cylinders 86 and 88 are in effect vented to the reservoir of the hydraulic supply unit, all while the clamping cylinders 64 remain energized. This allows the segment of the strip s to recover its elastic deformation, and indeed it does, bringing the movable frame 4 a short distance back toward the fixed frame 2.

Once the elastic deformation has been recovered, the clamping cylinders 64 are deenergized and at the same time the lifting cylinders 66 are energized. The lifting cylinders 66 lift the clamping units 50 upwardly, and in so doing release the strip s from the grip of the jaws 72 and 74 at both frames 2 and 4. The distance that the multiposition lifting cylinders 66 separate the jaws 72 and 74 on each frame 2 and 4 depends on the distortions in the strip s, for highly distorted strip s will need a greater separation than lightly distorted one.

Next the return cylinders 92 or the return cylinders 94 or both are energized so as to again position the movable frame 4 at the proper spacing with respect to the fixed frame 2. This spacing is of course designed to provide the desired amount of stretch when the spreading cylinders 86 and 88 are again energized.

After the jaws 72 and 74 have released the strip s, the strip s is advanced a distance no greater in length than the segment that had been stretched, which of course is for all intents and purposes equal to the spacing between the two sets of jaws 72 and 74. As the strip s advances, the leveled segment passes into the feeding machine f. The procedure is again repeated, producing an even longer portion of leveled strip. Eventually, the portion of leveled strip s is long enough to pass completely through and beyond the feeding machine f. At this time the feeding machine f is set in operation, its operating being coordinated with the stretching and leveling machine A.

When the feeding machine f and stretching and leveling machine A operate together, the feeding machine f draws the strip s through the stretching and leveling machine A. The coordination is such that the jaws 72 and 74 of the stretching and leveling machine A are open when the feeding machine advances the strip s. The feeding machine f advances the strip in increments which are no longer than the spacing between the sets of jaws 72 and 74 on the two frames 2 and 4, and preferably slightly less so that some overlap exists, and during the pauses between advances, some other operation may be formed on the leveled strip s beyond the feeding machine f. For example, the strip s may be severed at this time. In addition, the stretching and leveling machine A operates on the strip at this time to stretch and thereby level it in the manner previously described. The return cylinders 92 and 94 are energized while the strip s is advanced by the feeding machine f.

This invention is intended to cover all changes and modifications of the example of the invention herein chosen for purposes of the disclosure which do not constitute departures from the spirit and scope of the invention.

What is claimed is:

1. A machine for stretching sheet metal supplied in strip form to thereby level such metal strip, said machine comprising: first and second frames having a common path extending through them for accommodating the metal strip and being configured to allow the strip when not otherwise restrained to advance along the path in the direction of the path, each frame having a backing member that is fixed in position with respect to the frame, one of the frames being movable relative to the other frame in a direction parallel to the path; a clamping unit carried by each frame and being capable of moving toward and away from the backing member for the frame; a first jaw on the backing member of each frame and a second jaw located on the clamping unit for each frame directly opposite from the first jaw of that frame, whereby the distance between the first and second jaws of either frame may be varied by moving the clamping unit for that frame, the first jaw and second jaw of each frame each having a smooth clamping surface which extends across the path for substantially the full width of the path, with the clamping surfaces of the two jaws for each frame being located directly opposite each other, the first and second jaws of each frame being along the path such that the path passes between their clamping surfaces and when spread apart being open along their sides so that the strip may move along the path without interference from the jaws; first fluid-operated cylinders on each frame for forcing the clamping unit of the frame toward the backing member of the frame, thereby bringing the jaws for the frame together so that the strip is clamped between them with a clamping force exerted by the first cylinders, whereby a segment of metal strip is isolated between the jaws of the first frame and the jaws of the second frame; a plurality of second fluid-operated cylinders located along the path generally opposite one face of the isolated segment of metal strip for urging the frames apart, with the parting force exerted by the second cylinders being applied to the frames generally in the region of the backing members for the frames and in a direction generally parallel to the path and the strip that is along the path; a plurality of third fluid-operated cylinders located along the path generally opposite the other face of the isolated segment of metal strip for also urging the frames apart, with the parting force exerted by the third cylinders being applied to the clamping units in a direction generally parallel to the path and the strip that is along the path, whereby a stretching force is applied to the strip in the isolated region thereof that is between the jaws for the two frames, the clamping force exerted by the first cylinders being of a magnitude great enough to prevent the strip from slipping in the jaws when the stretching force is applied, and the stretching force exerted by the second and third cylinders being of a magnitude great enough to cause the strip to exceed its elastic limit and yield, whereby the strip is leveled in the region between the jaws of the two frames.

2. A machine according to claim 1 and further comprising fourth fluid-operated cylinders connected to the first and second frames for moving the frames together after they have been spread apart by the second and third cylinders.

3. A machine according to claim 2 wherein the second and third cylinders move the second frame away from the first frame to a predetermined spacing that is constant, and wherein the spacing between the frames after the fourth cylinders have moved them together is variable, whereby the distance that the strip is stretched is controlled by the fourth cylinders.

4. A machine according to claim 2 and further comprising fifth fluid-operated cylinders located on each frame and connected to the clamping assembly for the frame for moving that clamping assembly away from the backing member and thereby moving the jaws apart.

5. The machine of claim 1 in combination with a feeding machine that is located along the path, the feeding machine being capable of gripping the strip after it has been leveled and pulling it through the frames a predetermined increment of advance while the jaws of the two frames are separated, the increment of advance being no greater than the distance between the sets of jaws on the two frames.

6. A machine according to claim 1 wherein one of the jaws on each frame is supported on a cross member through which the clamping force is transmitted to that jaw; and wherein a flexible pad exists between each cross member and the jaw supported by that cross member so that the clamping force is also transmitted through the pad to the jaw, whereby the force from the first cylinder is applied generally uniformly across the metal strip.

7. A machine according to claim 6 wherein the pad is confined laterally so that it does not extrude out of the space between the cross member and the jaw which is supported on the cross member.

8. A machine according to claim 6 wherein the pad is formed from a polymer.

9. A process for leveling sheet metal strip without severing the strip, said process comprising: placing the strip between smooth clamping surfaces on sets of jaws at two spaced apart locations with the strip being substantially longer than the space between the jaws, so that an isolated segment of the strip exists between the sets of jaws and the remainder of the strip exists beyond one or both sets of the jaws, the clamping surfaces on the jaws at each spaced apart location extending across the entire width of the strip and beyond the edges of the strip; from an array of force means located in a transverse row both opposite the strip and beyond the edges of the strip, selecting only those force means that are opposite the strip for exerting clamping force on at least one of the jaws of each set; with the selected force means, forcing at least one of the jaws of each set toward the other jaw of that set by exerting clamping forces on that jaw at several locations opposite the strip, but generally not beyond the side of the strip, so that the jaws bear against the strip across the entire width of the strip without marring the strip; and forcing the one set of jaws away from the other set of jaws in a direction parallel to the strip, all while the sets of jaws remain clamped against the strip with a force great enough to prevent the strip from slipping in the jaws, the parting force with which the jaws are moved apart being great enough to cause the isolated segment of the strip to exceed its elastic limit, whereby the isolated segment of the strip is leveled.

10. The process according to claim 9 and further comprising: releasing the jaws after the isolated segment has been stretched, so that the jaws thereafter do not grip the strip; moving the sets of jaws a predetermined distance toward each other; advancing the strip; and thereafter repeating the steps of claim 9 so that a subsequent segment of the strip is stretched and leveled.

11. The process according to claim 10 and further comprising releasing the parting force before the jaws are released, and allowing the isolated segment to move the sets of jaws together as the isolated segment recovers its elastic deformation.

12. The process according to claim 11 and further comprising gripping the strip beyond the sets of jaws in the region where it has been stretched so as to advance the strip.

13. The process according to claim 9 wherein the parting force is applied to the sets of jaws opposite each face of the strip and between the frames.

14. A machine for stretching metal supplied in strip form to thereby level such metal strip, said machine comprising: first and second frames through which a path extends for accommodating the metal strip, one of the frames being movable toward and away from the other frame in a direction parallel to the path; jaws along the path at each frame, so that a set of jaws exists at the first frame and another set of jaws exists at the second frame, the two sets of jaws being spaced apart along the path, the jaws on each frame being positioned and configured such that the strip along the path will pass between and substantially beyond such jaws in the direction of the path; each frame having a backing member which is fixed in position with respect to that frame, the one jaw for each frame being mounted on the backing member of that frame; a clamping assembly mounted on each frame such as to move toward and away from the backing member for that frame and carrying the other jaw for that frame; force means for moving the clamping assembly of each frame toward the blocking member of that frame so as to bring the jaws for each frame toward each other to thereby enable them to clamp the strip between them at each frame, whereby a segment of strip is isolated between the two sets of jaws on the two frames, while the remainder of the strip exists beyond the jaws of one or both of the frames; spreading means located between the frames for forcing the two frames apart while the strip is clamped in the sets of jaws on those frames, with the spreading force exerted by the spreading means being applied at several transversely spaced locations opposite each face of the strip, the spreading force that is applied opposite one of the faces of the strip being applied to the movable clamping assemblies and the spreading force that is applied opposite the other face of the strip being applied to the backing members, the spreading means being capable of exerting enough force to cause the metal in the isolated segment of the strip to exceed its elastic limit, whereby the strip is leveled in the isolated segment between the sets of jaws; and return means for bringing the frames together before the clamping means causes the jaws to clamp down on the strip.

15. A machine according to claim 14 and further comprising separating means on each frame for retracting the clamping assembly on that frame from the backing member and thereby moving the jaws for the frame apart.

16. A machine according to claim 14 wherein the force means, the spreading means, the return means, and the separating means all comprise fluid-operated cylinders.

17. A machine for stretchinig metal supplied in strip form to thereby level such metal strip, said machine comprising: first and second frames through which a path extends for accommodating the metal strip, one of the frames being movable relative to the other frame in a direction parallel to the path; a first jaw and a second jaw carried by each frame such that the path extends between the two jaws, the first jaw being movable toward and away from the second jaw, each jaw having a smooth clamping surface which is presented toward the path and toward the other jaw and does not mar the metal strip when forced against the strip, each jaw further extending at least substantially the full width of the path and being continuous across the path; force means on each frame for applying forces to the first jaw several locations arranged transversely with respect to the path for forcing the first and second jaws of that frame together so that the metal strip is clamped between the jaws, whereby a segment of the strip is isolated between the jaws of the first frame and the jaws of the second frame, the force means being capable of exerting a clamping force on the jaws that is great enough to prevent the strip from slipping in the jaws when the frames are forced apart with enough force to stretch the isolated segment of strip beyond its elastic limit, the force means being operable selectively so that the forces need not be applied at all locations, whereby the forces which produce the clamping force may be generally confined to the portion of the path occupied by the strip, so that the strip is not marred at its edges; and spreading means for forcing the frames apart while the strip is clamped between the first and second jaws of the two frames, the spreading means being capable of exerting enough force to cause the metal in the isolated segment of strip to exceed its elastic limit, whereby the strip within the isolated segment is leveled.

18. A machine according to claim 17 and further comprising return means for bringing the frames together before the force means causes the jaws to clamp down on the strip.

19. A machine according to claim 18 wherein the return means positions the frames a predetermined distance apart, which distance may be adjusted, while the spreading means always separates the frames to a predetermined spacing, whereby the distance that the spreading means stretches the isolated segment between the jaws is controlled by the return means.

20. A machine according to claim 18 wherein the spreading means exerts the spreading force opposite each face of the strip.

21. A machine according to claim 17 wherein one of the frames is mounted in a fixed position on a supporting surface, and the other frame has wheels which move on tracks located along the supporting surface.

22. A machine according to claim 17 wherein one of the jaws of each set is backed by a thin layer of flexible material such that the clamping force exerted by the force means is transmitted through the flexible layer, whereby the clamping force is applied generally uniformly across the other jaw with which that one jaw aligns, and wherein the flexible material is confined laterally.

23. A machine according to claim 17 wherein the clamping surface of each jaw is flat.

24. A machine for stretching metal supplied in strip form to thereby level such metal strip, said machine comprising: first and second frames through which a path extends for accommodating the metal strip, one of the frames being movable relative to the other frame in a direction parallel to the path; a first jaw and a second jaw carried by each frame such that the path extends between the two jaws, each jaw having a smooth clamping surface which is presented toward the path and toward the other jaw and does not mar the metal strip when forced against the strip, each jaw further extending at least substantially the full width of the path; force means on each frame for forcing the first and second jaws of that frame together so that the metal strip is clamped between the jaws, whereby a segment of the strip is isolated between the jaws of the first frame and the jaws of the second frame, the force means being capable of exerting a clamping force on the jaws that is great enough to prevent the strip from slipping in the jaws when the frame are force apart with enough force to stretch the isolated segment of strip beyond its elastic limit, the force means for each frame including a plurality of clamping cylinders which are arranged transversely with respect to the path, each cylinder being oriented such that it will exert a force on the first jaw of the frame to urge that jaw toward the second jaw for the frame, the cylinders being connected to a source of pressurized fluid such that they can be selectively energized to concentrate the clamping force applied at the first and second jaws of the frame to those regions of the jaws that are in contact with the metal strip, but not substantially beyond the side edges of the strip; and spreading means for forcing the frames apart while the strip is clamped between the first and second jaws of the two frames, the spreading means being capable of exerting enough force to cause the metal in the isolated segment of strip to exceed its elastic limit, whereby the strip within the isolated segment is leveled.

25. A machine according to claim 24 wherein each first jaw is supported on a cross member through which the force from the clamping cylinders is transmitted to the jaws and wherein a thin pad of flexible material exists between each cross member and the first jaw supported on that cross member so that the force of the clamping cylinders is also transmitted through the pad, whereby the force from the clamping cylinders is applied generally uniformly across the metal strip.

26. A machine according to claim 25 wherein the pad is formed from a polymer.

27. A machine for stretching sheet metal supplied in strip form to thereby level such metal strip, said machine comprising: first and second frames having a common path extending through them for accommodating the metal strip and being configured to allow the strip when not otherwise restrained to advance along the path in the direction of the path, each frame having a backing member that is fixed in position with respect to the frame, one of the frames being movable relative to the other frame in a direction parallel to the path; a clamping unit carried by each frame and being capable of moving toward and away from the backing member for the frame; a first jaw on the backing member of each frame and a second jaw located on the clamping unit for each frame directly opposite from the first jaw of that frame, whereby the distance between the first and second jaws of either frame may be varied by moving the clamping unit for that frame, the first jaw and second jaw of each frame each having a smooth clamping surface which extends across the path for substantially the full width of the path, with the clamping surfaces of the two jaws for each frame being located directly opposite each other, the first and second jaws of each frame being along the path such that the path passes between their clamping surfaces and when spread apart being open along their sides so that the strip may move along the path without interference from the jaws; first fluid-operated cylinders arranged on each frame in a row that extends transversely with respect to the path for forcing the clamping unit of the frame toward the backing member of the frame, thereby bringing the jaws for the frame together so that the strip is clamped between them with a clamping force exerted by the first cylinders, whereby a segment of metal strip is isolated between the jaws of the first frame and the jaws of the second frame, the first cylinders of each frame being connected to a source of pressurized fluid such that they can be selectively energized to concentrate the clamping force applied at the jaws to the regions of the jaws that are in contact with the metal strip, but not substantially beyond the side edges of the strip, whereby the jaws do not mar the strip along its edges; second fluid-operated cylinders located along the path for urging the frames apart, with the parting force being applied to the frames generally in the region of the backing members for the frames and in a direction generally parallel to the path and the strip that is along the path; third fluid-operated cylinders located along the path for urging the frame apart, with the parting force being applied to the clamping units in a direction generally parallel to the path and the strip that is along the path, whereby a stretching force is applied to the strip in the isolated region thereof that is between the jaws for the two frames, the clamping force exerted by the first cylinders being of a magnitude great enough to prevent the strip from slipping in the jaws when the stretching force is applied, and the stretching force exerted by the second and third cylinders being of a magnitude great enough to cause the strip to exceed its elastic limit and yield, whereby the strip is leveled in the region between the jaws of the two frames.

* * * * *